US007777768B2

(12) United States Patent
Nakasendo

(10) Patent No.: US 7,777,768 B2
(45) Date of Patent: Aug. 17, 2010

(54) IMAGE FORMING APPARATUS

(75) Inventor: Takashi Nakasendo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 50 days.

(21) Appl. No.: 12/199,946

(22) Filed: Aug. 28, 2008

(65) Prior Publication Data

US 2009/0060581 A1 Mar. 5, 2009

(30) Foreign Application Priority Data

Aug. 30, 2007 (JP) ..... 2007-223755

(51) Int. Cl.
*B41J 2/447* (2006.01)
*B41J 2/45* (2006.01)
*B41J 2/52* (2006.01)

(52) U.S. Cl. ..... 347/131; 347/240

(58) Field of Classification Search ..... 347/131, 347/240

See application file for complete search history.

(56) References Cited

U.S. PATENT DOCUMENTS 7,358,983 B2 * 4/2008 Yaji et al. ..... 347/255

2008/0055670 A1 * 3/2008 Nakasendo ..... 358/472

FOREIGN PATENT DOCUMENTS

JP 07-156442 A 6/1995

OTHER PUBLICATIONS

Computer-generated translation of JP 07-156442 cited in the IDS dated Aug. 28, 2008.*

* cited by examiner

*Primary Examiner*—Huan H Tran
(74) *Attorney, Agent, or Firm*—Panitch Schwarze Belisario & Nadel LLP

(57) ABSTRACT

An image forming apparatus is capable of printing half-toned images of high quality. The image forming apparatus includes a photoconductive body and a light emitting element array. A plurality of light emitting elements is aligned in the light emitting element array. Each light emitting element array emits light to form an electrostatic latent image of a pixel on the photoconductive drum. A controller controllably drives the plurality of light emitting elements to form the electrostatic latent image, each pixel being formed by a combination of a total of N (N>1) light emitting elements. Each element of the N light emitting elements is driven with a different amount of energy from remainders of the N light emitting elements.

10 Claims, 14 Drawing Sheets

FIG.17
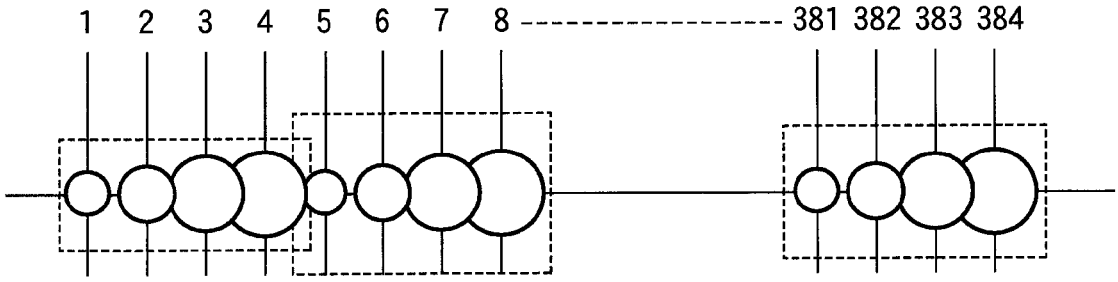
FIG.18A
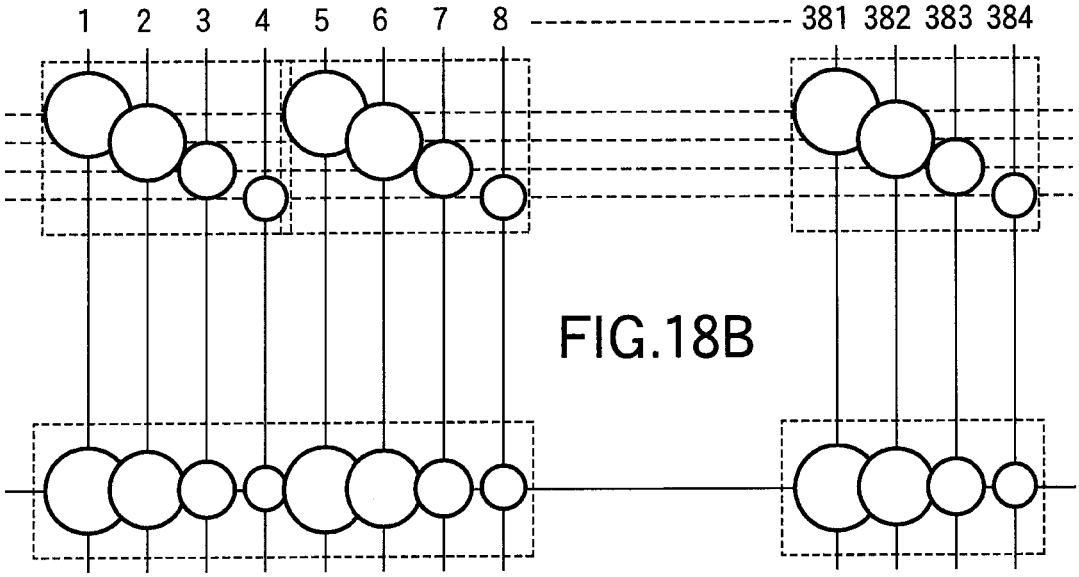
FIG.18B

IMAGE FORMING APPARATUS

BACKGROUND OF THE INVENTION

1. Field of the Invention

The present invention relates to an image forming apparatus.

2. Description of the Related Art

An electrophotographic image forming apparatus incorporates an exposing unit. The exposing unit includes a plurality of light emitting elements. The light emitting elements are driven in accordance with print data to form an electrostatic latent image on a photoconductive body. The electrostatic latent image is then developed into a visible image. JP H07-156442 A discloses one such image forming apparatus. The light emitting elements are driven such that a single pixel is formed by selectively driving a predetermined number of light emitting elements according to the image density of the print data. This way of driving light emitting elements makes it possible to print images having a resolution of, for example, 600 dpi, 400 dpi or 300 dpi by using an exposing unit having a resolution of 1200 dpi.

However, this type of image forming apparatus is not capable of printing halftoned pixels, failing to produce prints with a desired print quality.

SUMMERY OF THE INVENTION

The present invention was made in view of the aforementioned prior art problem.

An object of the present invention is to provide an image forming apparatus in which individual pixels are halftoned.

Another object of the invention is to provide an image forming apparatus capable of printing high quality images.

An image forming apparatus is capable of printing halftoned images of high quality. The image forming apparatus includes a photoconductive body and a light emitting element array. A plurality of light emitting elements is aligned in the light emitting element array. Each light emitting element array emits light to form an electrostatic latent image of a pixel on the photoconductive drum. A controller controllably drives the plurality of light emitting elements to form the electrostatic latent image, each pixel being formed by a combination of a total of N (N>1) light emitting elements. Each element of the N light emitting elements is driven with a different amount of energy from remainders of the N light emitting elements.

The N light emitting elements are arranged so that they are staggered. Each of N light emitting elements is displaced ahead of a preceding one in the advance direction by a distance equivalent to a first resolution provided that the electrostatic latent image is formed on the photoconductive drum at a second resolution in a direction perpendicular to the advance direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 17 illustrates dots formed on a photoconductive drum;

FIG. 18A illustrates the arrangement of the LEDs of the second embodiment; and FIG. 18B illustrates the dots formed on the photoconductive drum using the arrangement of the LEDs shown in FIG. 18A.

DETAILED DESCRIPTION OF THE PRESENT INVENTION

Embodiments of the invention will be described with reference to the accompanying drawings.

First Embodiment

An image forming apparatus of the embodiment will be described in terms of an electrophotographic printer employing light emitting diodes (LEDs).

Figure 1:
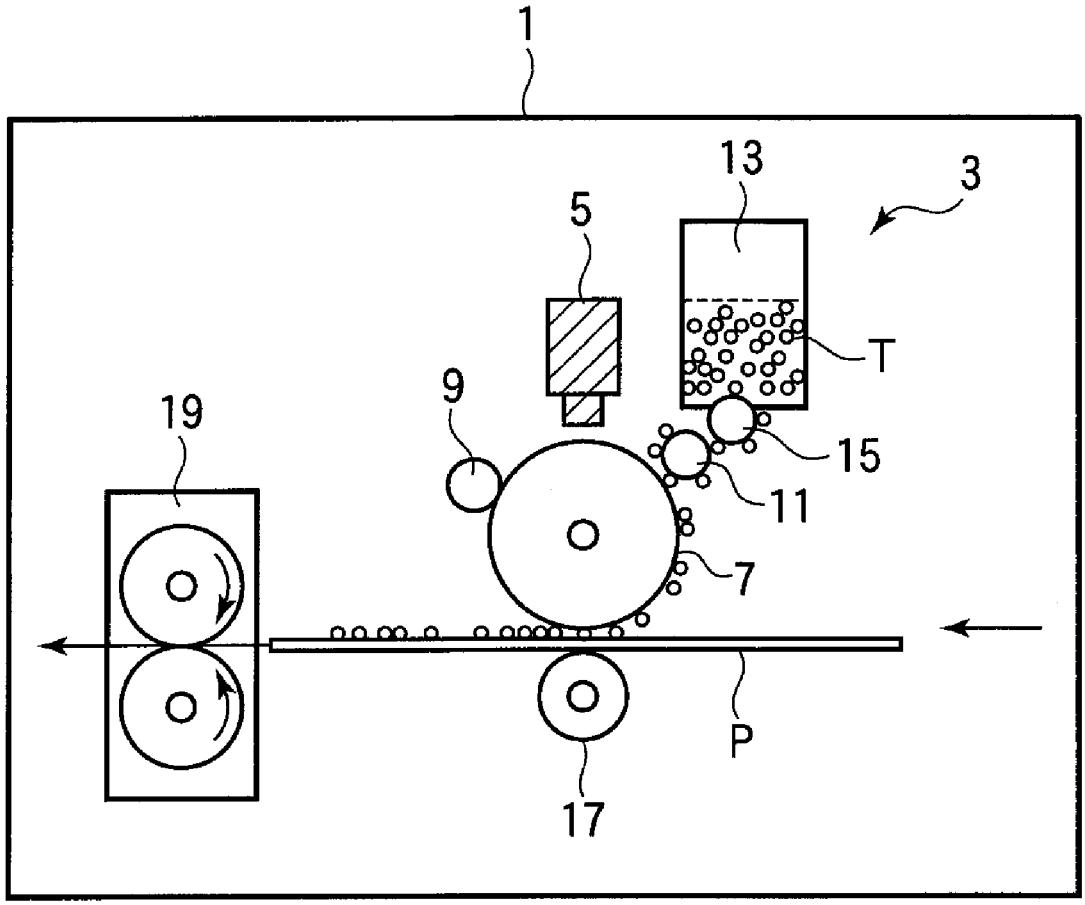
FIG. 1 illustrates the general configuration of an image forming section of a printer.

FIG. 1 illustrates the general configuration of an image forming section 3 of a printer 1. The image forming section 3 forms a developer image in accordance with print data received from an information processing apparatus such as a personal computer. The image forming section 3 includes a photoconductive drum 7, a charging roller 9, a developing roller 11, and a developer supplying roller. The charging roller 9 charges the surface of the photoconductive drum 7. An LED head 5 illuminates the charged surface of the photoconductive drum 7 to form an electrostatic latent image in accordance with the print data. The developing roller 11 supplies a developer material T to the electrostatic latent image, thereby forming a developer image. The developer supplying roller 15 supplies the developer material T from a toner hopper 13 to the developing roller 11. The developer image is then transferred by a transfer roller 17 onto paper P fed by a transport mechanism (not shown). The paper P is then advanced to a fixing unit 19 where the developer image is fused into the paper P by heat and pressure.

Figure 2:
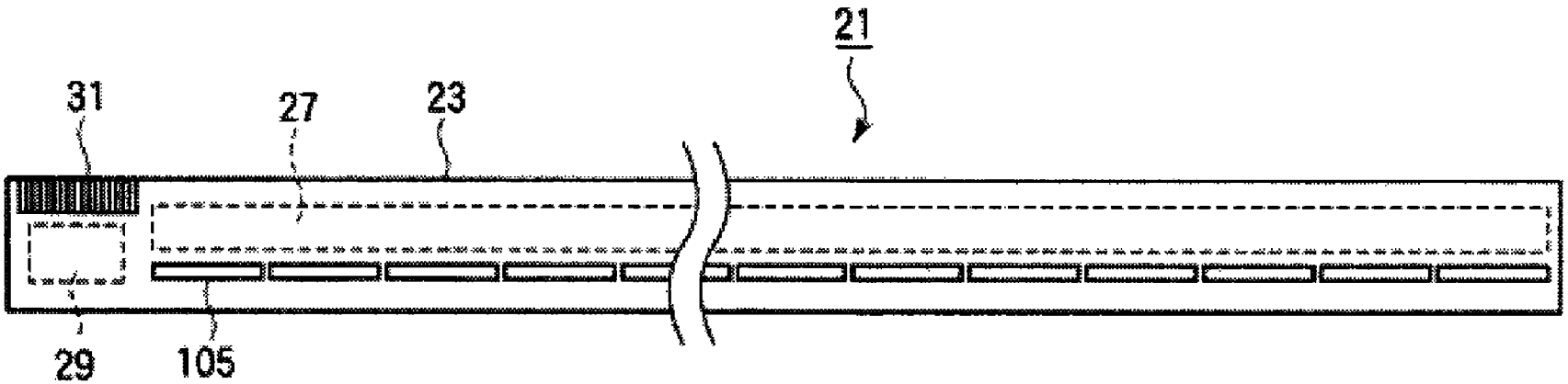
FIG. 2 is a top view of an LED head.

FIG. 2 is a top view of the LED head 5.

Referring to FIG. 2, the LED head 5 includes an LED assembly 21. The LED assembly 21 includes a print circuit board 23, LED arrays 105, electronic parts mounting areas 27 and 29, and a connector 31. The print circuit board 23 extends in a longitudinal direction and supports the LED arrays 105 aligned in the longitudinal direction. A variety of electronic parts are mounted in the electronic parts mounting areas 27 and 29. The connector 31 is connected to the body of the printer 1 to receive a variety of commands and signals from the body of the printer 1. The variety of commands and signals are processed by the electronic circuits formed in the electronic parts mounting areas 27 and 29 before the commands and signals are supplied to the individual LED arrays 105. A total of 26 light emitting arrays 105 are mounted on the LED assembly 21. The LED assembly 21 are mounted to a base 33 (FIG. 3), thereby implementing the LED head 5.

Figure 3:
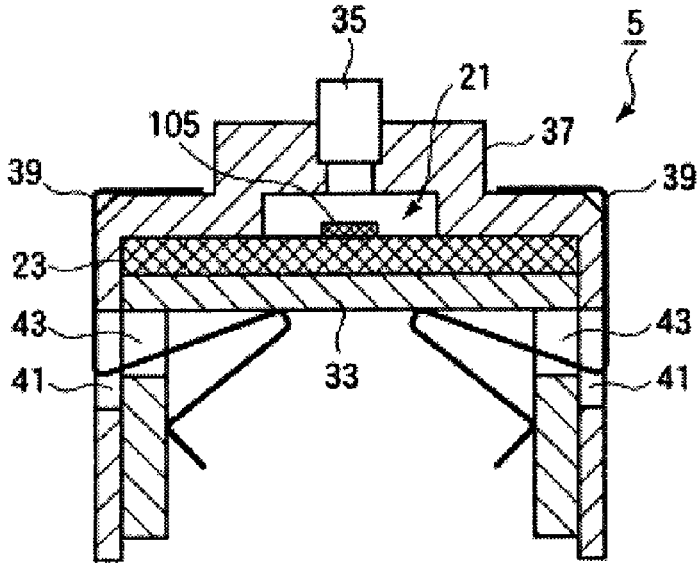
FIG. 3 is a cross-sectional view of the LED head.

FIG. 3 is a cross-sectional view of the LED head 5.

The LED head 5 further includes a rod lens array 35 and a lens holder 37. The rod lens array 35 is supported directly over the LED arrays 105. The lens holder 37 holds the rod lens array 35 in a predetermined position. The rod lens array 35 includes a plurality of cylindrical optical lenses aligned in a direction parallel to the LED array.

The lens holder 37 is configured to enclose the LED arrays 105 and hold the LED assembly 21 mounted on the base 33. Specifically, the lens holder 37 includes openings 43 through which dampers 39 are inserted to hold the base 33 and lens holder 37 together, thereby positioning the base 33 and the LED assembly 21.

Figure 4:
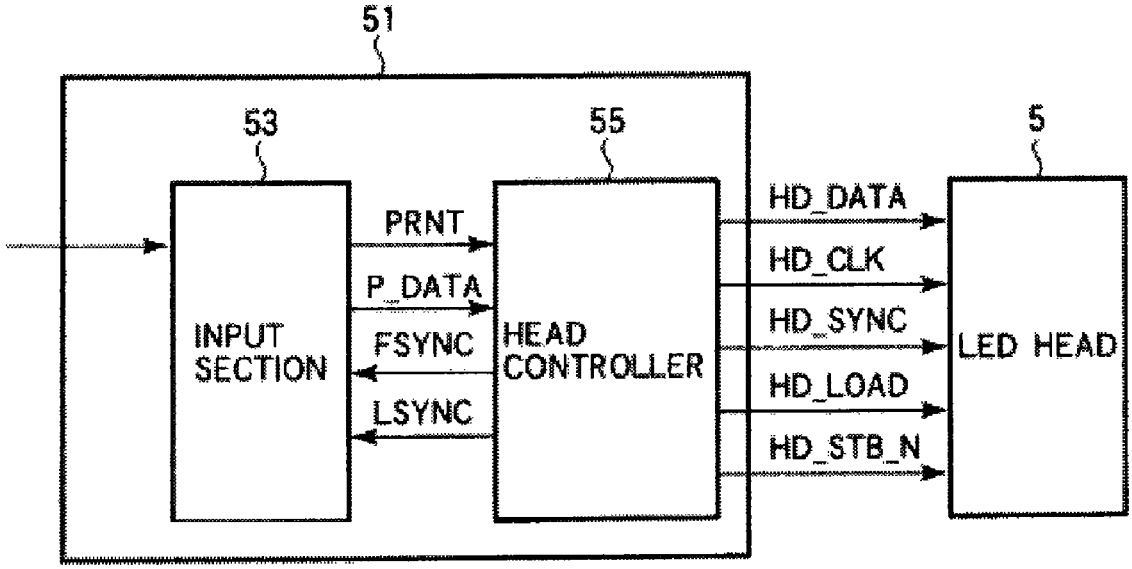
FIG. 4 illustrates a control circuit.

FIG. 4 illustrates a control circuit 51.

The printer 1 includes the control circuit 51 which receives print data from a host apparatus and provides various types of signals to the LED assembly 21. The control circuit 51 includes an input section 53 through which the print data is received from a host apparatus, and a head controller 55 that controllably drives the LED head 5 in accordance with the print data. The control circuit 51 further includes an image processing section (not shown) that processes the print data, a process control section (not shown) that controls the electrophotographic process, and a mechanism control section (not shown) that controls respective mechanisms in the printer 1.

The input section 53 generates print data P-DATA for one line based on the received print data. When the print data P-DATA is ready to be outputted, the input section 53 sends a print command PRNT to the head controller 55, and then sends the print data P-DATA to the head controller 55.

Figure 5:
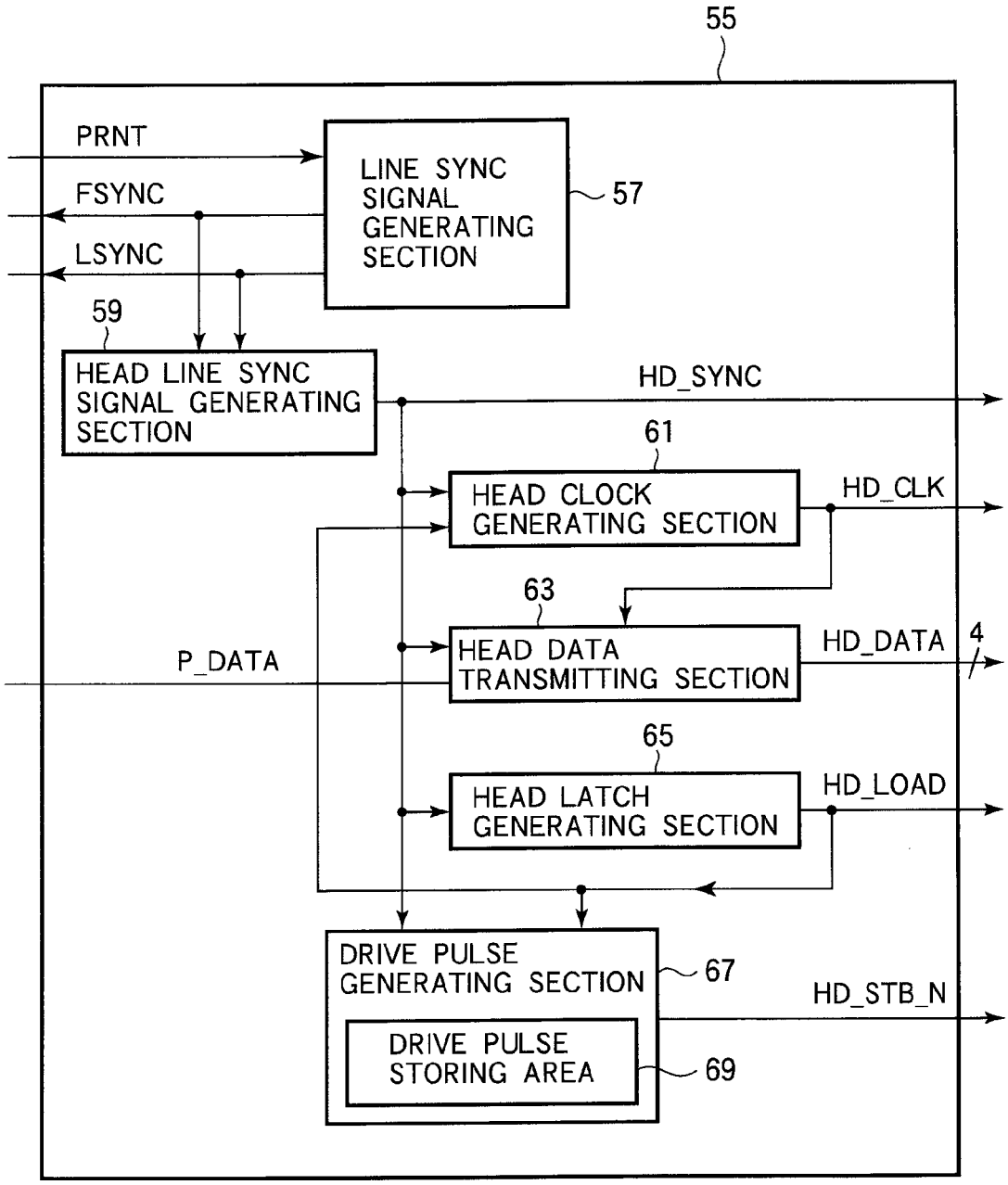
FIG. 5 illustrates details of a head controller.

FIG. 5 illustrates details of the head controller 55.

The head controller 55 generates head data HD-DATA based on the print data P-DATA, and sends the head data HD-DATA to the LED head 5. Specifically, the head controller 55 includes a line sync signal generating section 57, a head line sync signal generating section 59, a head clock generating section 61, a head data transmitting section 63, a head latch generating section 65, and a drive pulse generating section 67. The line sync signal generating section 57 outputs a transmission command FSYNC and a line sync signal LSYNC in response to the print command PRNT received from the input section 53. The head line sync signal generating section 59 outputs a head sync signal HD-SYNC in response to the transmission command FSYNC and the line sync signal LSYNC. The head clock generating section 61 generates a head clock HD-CLK. The head data transmitting section 63 outputs head data HD-DATA in accordance with the print data P-DATA. The head latch generating section 65 outputs a head load signal HD-LOAD in response to the line sync signal HD-SYNC. The drive pulse generating section 67 generates a strobe signal HD-STB-N in response to the line sync signal HD-SYNC.

Upon receiving the print command PRNT from the input section 53, the head controller 55 provides the transmission command FSYNC to the input section 53. In response to the transmission command FSYNC, the input section 53 outputs the print data P-DATA for one line to the head controller 55. Then, the head controller 55 sends the head data HD-DATA corresponding to the one line of print data P-DATA to the LED head 5, and then outputs the line sync signal LSYNC to the input section 53. The line sync signal LSYNC is outputted from the head controller 55 to the input section 53 every time an electrostatic latent image for one line is generated. The input section 53 outputs the print data P-DATA for one line to the head controller 55 every time the line sync signal LSYNC is received from the head controller 55.

Upon receiving the print command PRNT, the line sync generating section 57 generates the transmission command FSYNC, and sends the transmission command FSYNC to the input section 53 and the head line sync signal generating section 59. The line sync generating section 57 also generates the line sync signal LSYNC at predetermined time intervals, and sends the line sync signal LSYNC to the input section 53 and the head line sync signal generating section 59.

In response to the line sync signal LSYNC, the head line sync signal generating section 59 generates a head sync signal HD-SYNC and sends the head sync signal HD-SYNC to the head clock generating section 61, LED head 5, the head data transmitting section 63, the head latch generating section 65, and the drive pulse generating section 67.

In response to the head sync signal HD-SYNC, the head clock generating section 61 generates the head clock HD-CLK having a predetermined clock speed, and sends the head clock HD-CLK to the LED head 5 and head data transmitting section 63. The head data transmitting section 63 converts the print data P-DATA into the head data HD-DATA, and holds the head data HD-DATA therein. The head data transmitting section 63 then sends the head data HD-DATA to the LED head 5 on the head clock HD-CLK received from the head clock generating section 61. The number of bits in the head data HD-DATA for each pixel is equal to the number of light emitting diodes (LEDs) driven by the head data HD-DATA. In other words, the head data transmitting section 63 converts the print data P-DATA into the head data HD-DATA having 4 bits, and then sends the 4-bit head data HD-DATA to the LED head 5. For the sake of convenience, it is assumed that the printer 1 forms an electrostatic latent image for one pixel by driving four consecutive LEDs.

A predetermined time after receiving the head sync signal HD-SYNC, the head latch generating section 65 generates the head load signal HD-LOAD and provides the head load signal HD-LOAD to the drive pulse generating section 67, head clock generating section 61, and LED head 5.

Upon receiving the head load signal HD-LOAD, the drive pulse generating section 67 generates the head strobe HD-STB-N having a predetermined duration, the head strobe HD-STB-N being sent to the LED head 5. The drive pulse generating section 67 includes the drive pulse storing area 69 that stores information on a plurality of pulse widths. The drive pulse generating section 67 reads the information on the pulse width from the drive pulse storing section 69, and generates the head strobe HD-STB-N having appropriate pulse widths. The head strobe HD-STB-N is fed to the LED head 5. The head strobe HD-STB-N includes a series of different pulse widths S1, S2, S3, and S4 for data $\mathbf{1}_{-1}$, $\mathbf{1}_{-2}$, $\mathbf{1}_{-3}$, and $\mathbf{1}_{-4}$, respectively, so that the four LEDs that form a single pixel are driven with different amounts of energy. This will be described later in more detail.

Figure 6:
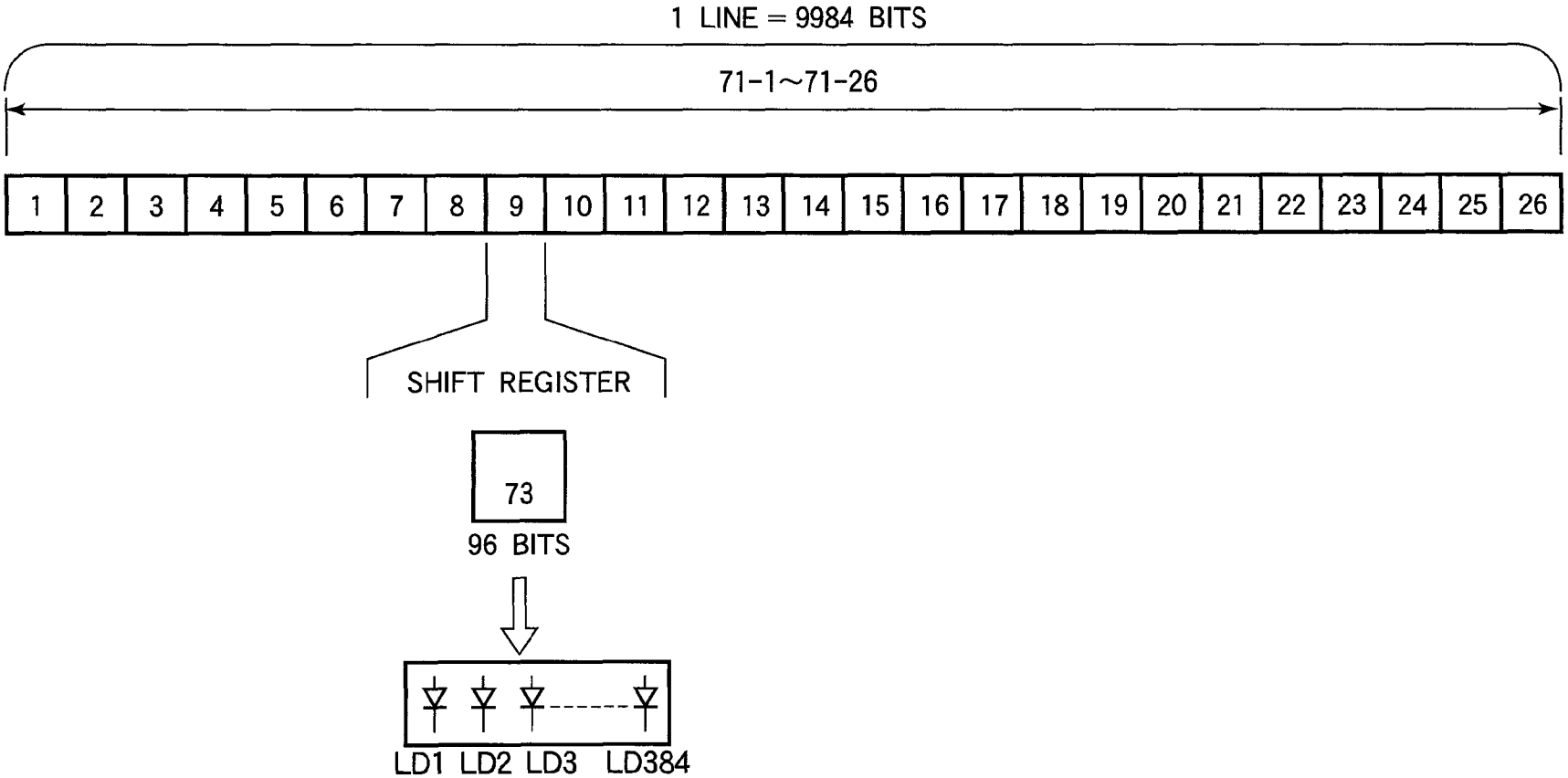
FIG. 6 illustrates the general configuration of the LED head.

FIG. 6 illustrates the general configuration of the LED head 5.

Figure 8:
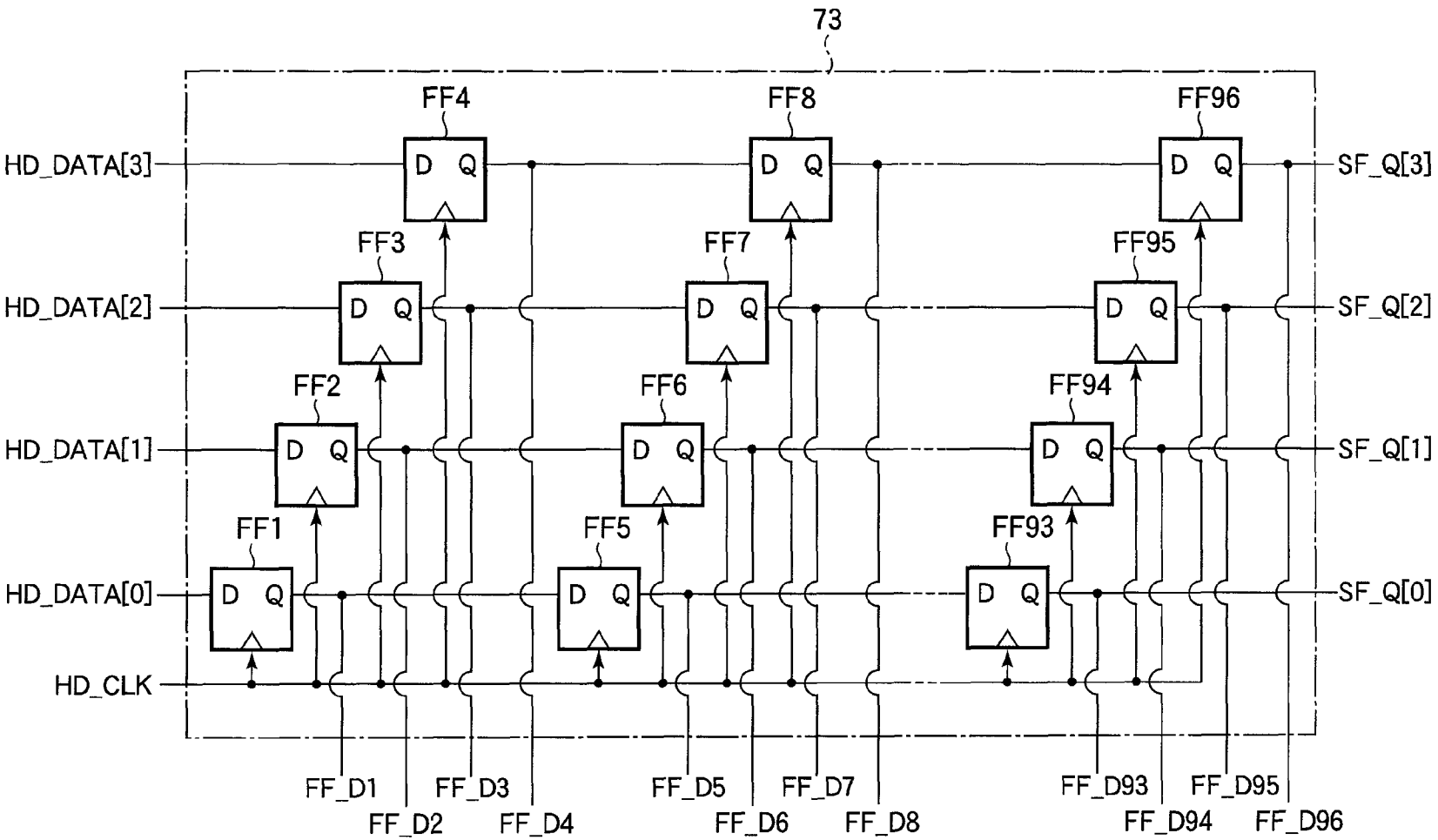
FIG. 8 illustrates the details of a shift register.

The LED head 5 includes 26 line drivers $71_{-1}$ to $71_{-26}$. Each line driver 71 includes a shift register 73 (FIG. 8). The shift register 73 includes four 24-stage shift register circuits that hold a total of 96 bits. Four shift register circuits hold a total of 384 bits of data, which drive 384 LEDs in the LED array 105. The LED head 5 includes a total of 384×26=9984 LEDs aligned in the longitudinal direction of the LED head 5.

Figure 7:
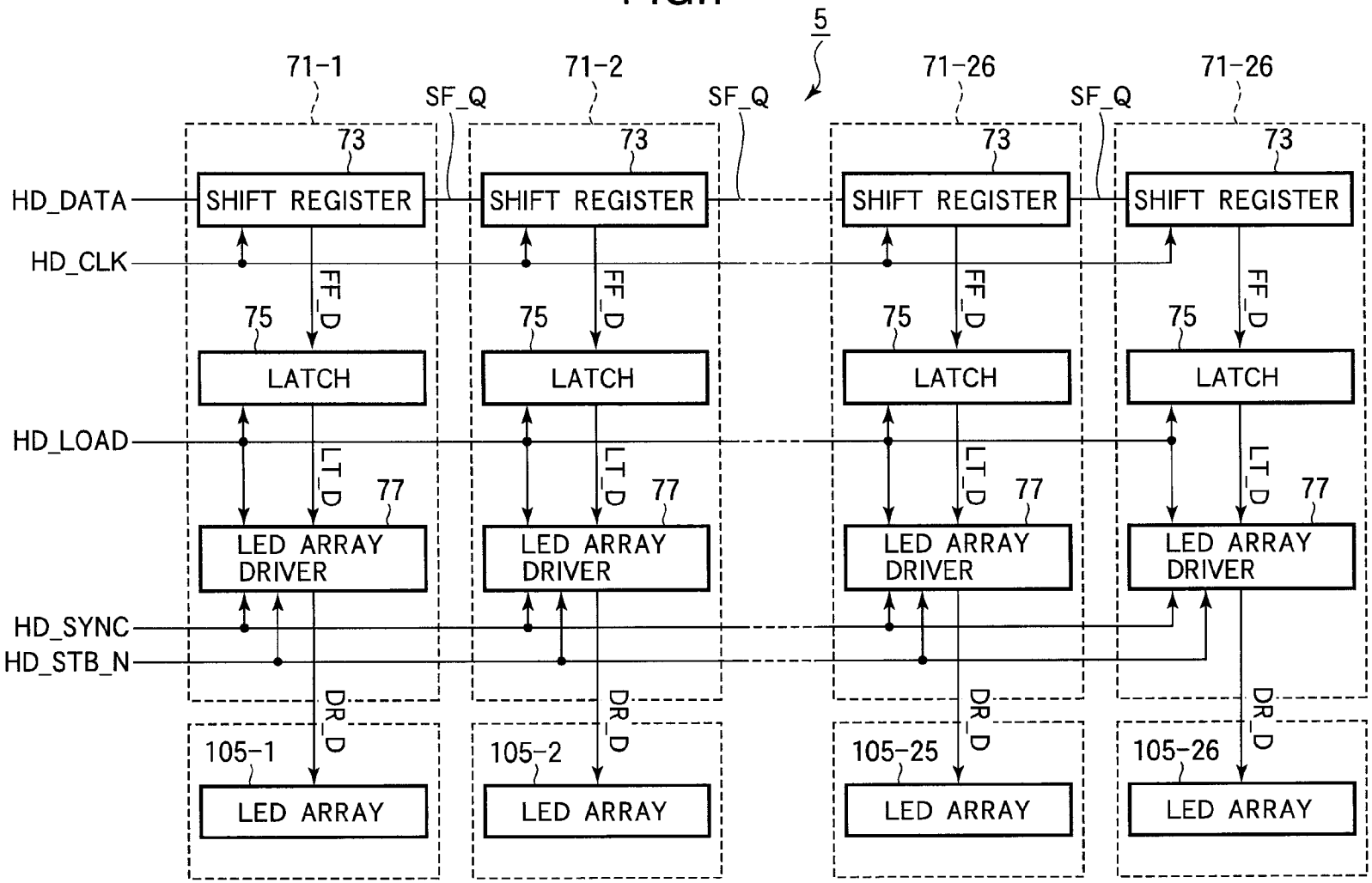
FIG. 7 illustrates the details of line drivers.

FIG. 7 illustrates the details of the line drivers 71.

Referring to FIG. 7, the LED head 5 includes line drivers $71_{-1}$ to $71_{-26}$ that supply drive signals DR-D to LEDs of the LED array 105. Specifically, the LED head 5 includes 26 LED arrays $105_{-1}$ to $105_{-26}$, aligned in a straight line and driven by corresponding line drivers $71_{-1}$ to $71_{-26}$. The line drivers $71_{-1}$ to $71_{-26}$ provide the driver signals DR-D1 to DR-D96 (FIG. 10) to their LED arrays $105_{-1}$ to $105_{-26}$, respectively, thereby driving the LEDs in the LED array 105 in accordance with the head data HD-DATA. Each of the LED arrays $105_{-1}$ to $105_{-26}$ and line drivers $71_{-1}$ to $71_{-26}$ may be substantially identical; they will be referred to as LED arrays 105 and line drivers 71 for simplicity, it being understood that the other LED arrays 105 and line drivers may work in a similar fashion.

Each line driver 71 includes a shift register 73, a latch 75, and an LED-array driver 77. The shift register 73 outputs data signal FF-D produced based on the head data HD-DATA. The latch 75 latches the data signal FF-D. The LED-array driver 77 outputs a signal DR-D to the LED arrays 105 in accordance with the latch data LT-D received from the latch 75. The shift register 73 receives and latches the data signal FF-D on the head clock HD-CLK. The data signal FF-D in the latch 75 is then outputted to the LED-array driver 77. In response to the head sync signal HD-SYNC and head strobe HD-STB-N, the LED-array driver 77 outputs the driver signal DR-D to the LED arrays $105_{-1}$ to $105_{-26}$.

FIG. 8 illustrates the details the shift register 73. Referring to FIG. 8, the shift register 73 includes 96 flip-flops FF1 to FF96. The 96 flip-flops are divided into four 24-stage shift register circuits. The shift register circuits each include 24 cascaded flip-flops. A shift register circuit includes FF1, FF5, FF9, . . . , FF93, and receives the head data HD-DATA[0]. Another shift register circuit includes FF2, FF6, FF10, . . . , FF94, and receives the head data HD-DATA[1]. Yet another shift register circuit includes FF3, FF7, FF11, . . . , FF95, and receives the head data HD-DATA[2]. Still another shift register circuit includes FF4, FF8, FF12, . . . , FF96, and receives the head data HD-DATA[3]. Likewise, the four flip-flops FF1 to FF4 each hold one bit of information FF-D1 to FF-D4, respectively, that drives corresponding LEDs to form a single pixel. The flip-flops of the respective shift register circuits receive the head clock HD-CLK from the head clock generating section 61. The flip-flops output the data signals FF-D from their Q terminals on the head clock HD-CLK, the data signals FF-D of a preceding stage (e.g., FF1-FF4) of two consecutive stages (e.g., FF1-FF4 and FF5-FF8) being inputted into a following stage (e.g., FF5 to FF8). The Q terminals of the final stage (FF93-FF96) of a preceding one of two consecutive line drivers 71 are connected to the D terminals of the first stage (FF1-FF4) of a following one of the two consecutive line drivers 71. Thus, the signals SF-Q on the Q terminals of the final stages (FF93-FF96) of a preceding one of two consecutive line drivers 71 are inputted into the D terminals of the first group (FF1-FF4) of a following one of two consecutive line drivers 71.

Figure 9:
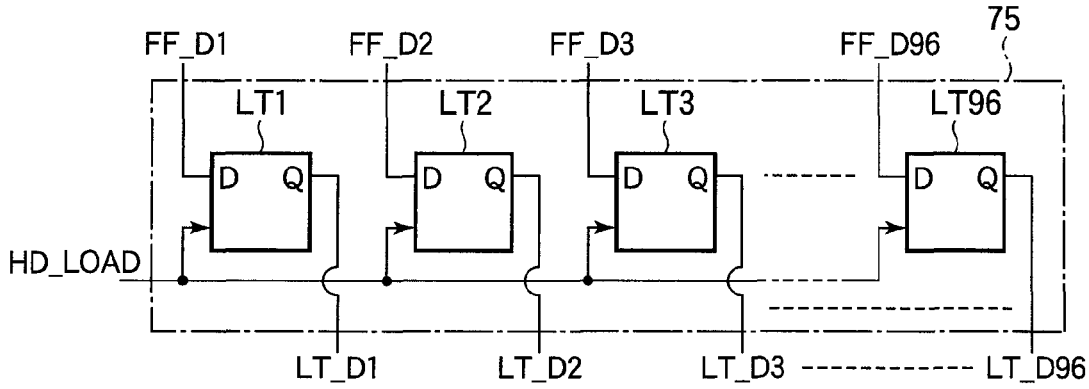
FIG. 9 illustrates the details of a latch.

FIG. 9 illustrates the details of the latch 75.

The latch 75 includes 96 latch circuits LT1-LT96 corresponding to 96 flip-flops FF1-FF96. The D terminals of the latch circuits LT1-LT96 receive data signals FF-D1 to FF-D96 outputted from the FF1-FF96. Upon receiving the head load signal HD-LOAD, the latch circuits LT1-LT96 latch the data signals FF-D1 to FF-D96. Then, the latch circuits LT1-LT96 outputs the latch data signals LT-D1 to LT-D96 to the LED-array driver 77.

Figure 10:
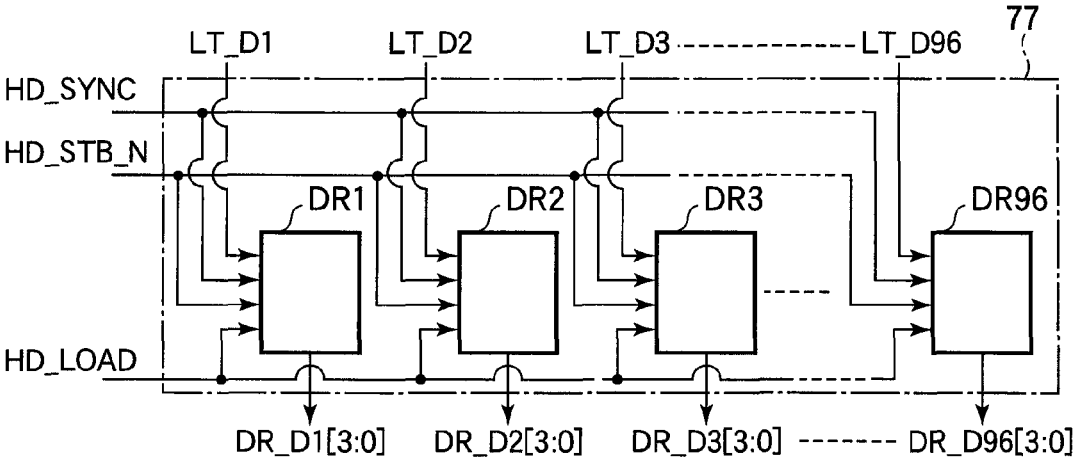
FIG. 10 illustrates the details of an LED-array driver.

FIG. 10 illustrates the details of the LED-array driver 77.

The LED-array driver 77 includes 96 bit-drivers DR1-DR96 corresponding to the latch circuits LT1-LT96. Each of the 96 bit-drivers DR1-DR96 is used four times (i.e., for HD-DATA[1], HD-DATA[1], HD-DATA[1], and HD-DATA [1]), thereby forming a pixel having a corresponding halftone level. In other words, Each of the 96 bit-drivers DR1-DR96 drives 4 consecutive LEDs in sequence, only one LED at a time, thus forming a single pixel.

The bit-drivers DR1-DR96 receive the latch data signals LT-D1 to LT-D96 from the corresponding latch circuits LT1-LT96. The bit-drivers DR1-DR96 receive the head sync signal HD-SYNC, the head strobe HD-STB-N, and the head load signal HD-LOAD from the head controller 55. In response to these signals, the bit-drivers DR1-DR96 output driver signals DR-D1 to DR-D96 to the LED array 105. Each of the bit-drivers DR1-DR96 may be substantially identical; the operation of only the bit-driver DR1 will be described for simplicity, it being understood that the other bit-drivers DR2-DR96 may work in a similar fashion.

Figure 11:
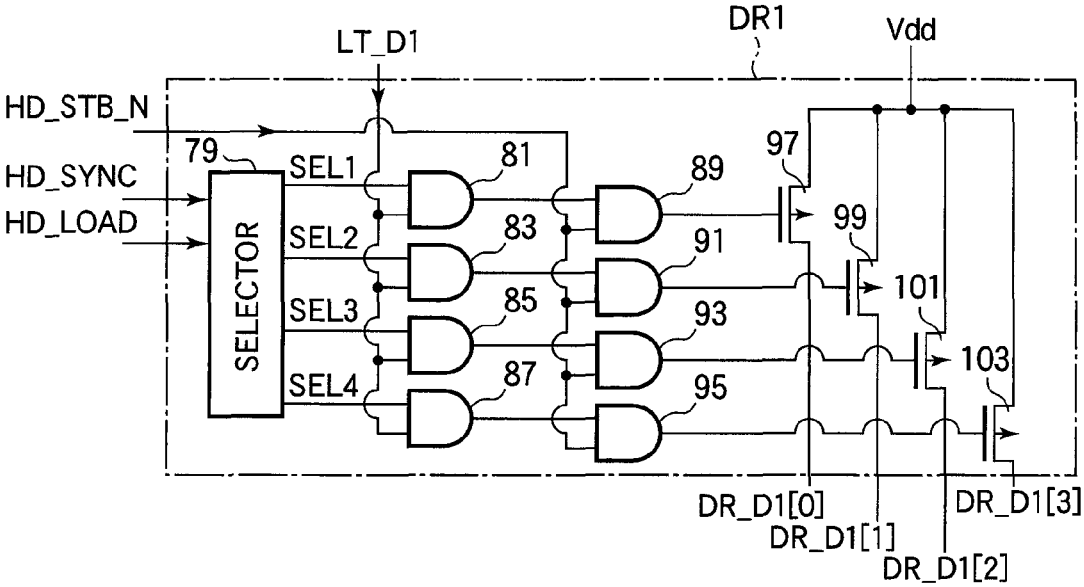
FIG. 11 illustrates the details of a bit driver.

FIG. 11 illustrates the details of the bit-driver DR1.

Figure 12A:
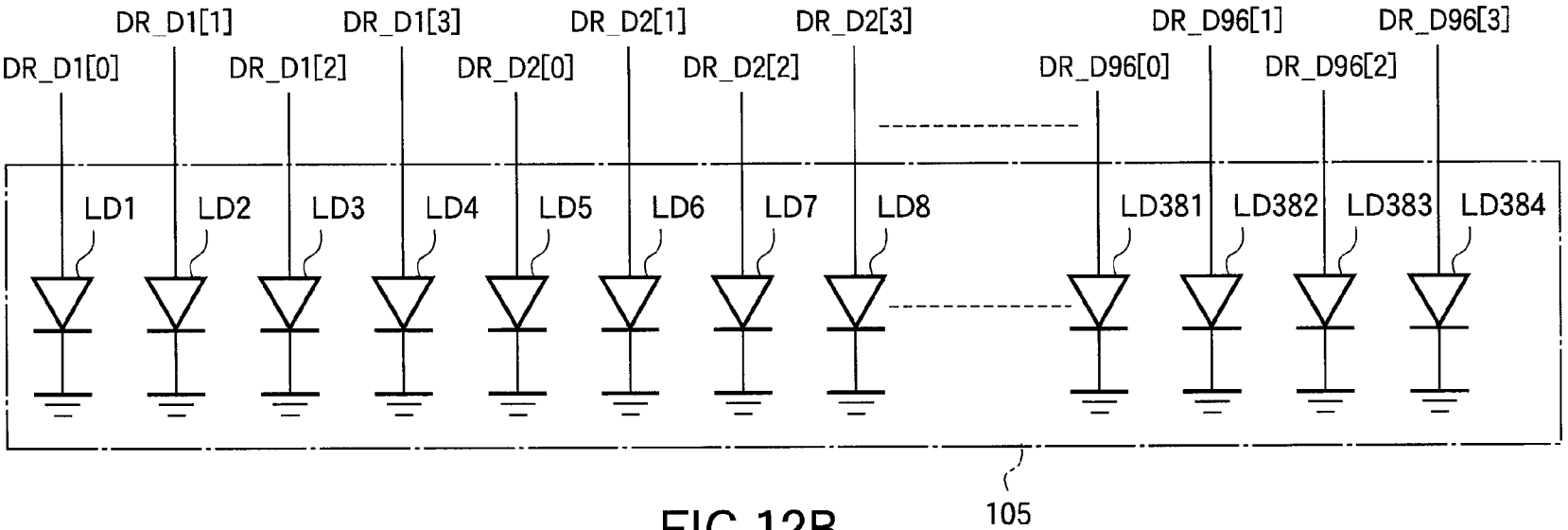
FIGS. 12A and 12B illustrate an LED array.
Figure 12B:
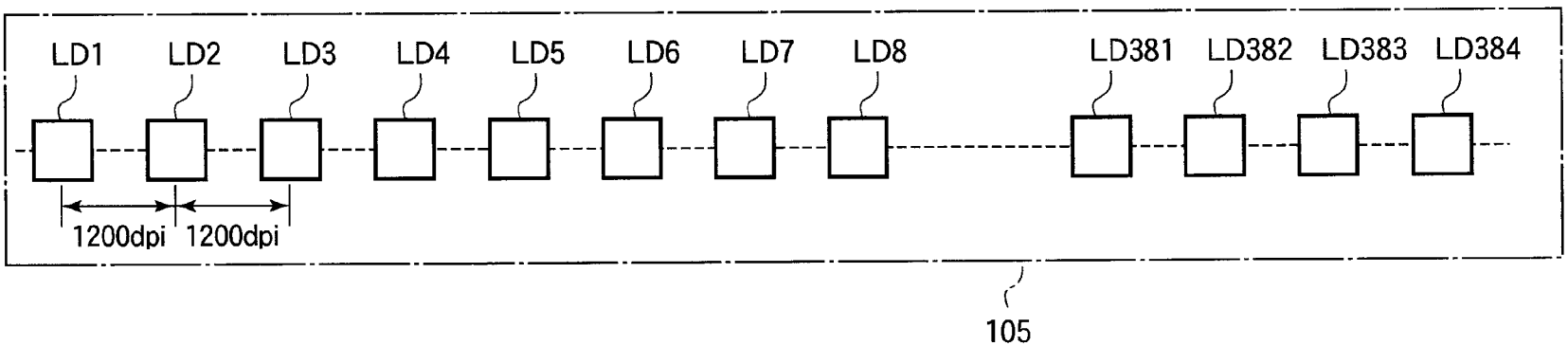

FIGS. 12A-12B illustrates LED arrays 105.

Referring to FIG. 11, the bit driver DR1 includes a selector circuit 79, AND circuits 81, 83, 85, and 87, AND circuits 89, 91, 93, and 95, and PMOS transistors 97, 99, 101, and 103. The selector circuit 79 receives the head sync signal HD-SYNC and the head load signal HD-LOAD. The selector circuit 79 outputs the selector signals SEL1, SEL2, SEL3, and SEL4 sequentially in accordance with the head load signal HD-LOAD and head sync signal HD-SYNC. The selector signals SEL1, SEL2, SEL3, and SEL4 are inputted to corresponding AND gates 81, 83, 85, and 87, respectively. The latch data signal LT-D and the selector signals SEL1, SEL2, SEL3, and SEL4 are ANDed by the AND gates 81, 83, 85, and 87 respectively. The head strobe HD-STB-N and the outputs of the AND gates 81, 83, 85, and 87 are ANDed by the AND gates 89, 91, 93, and 95 818, respectively. The outputs of the AND gates 89, 91, 93, and 95 are fed to the gates of the PMOS transistors 97, 99, 101, and 103, respectively. The drains of the PMOS transistors 97, 99, 101, 103 are connected to a supply voltage Vdd and the source of the PMOS transistors 97, 99, 101, 103 are connected to light emitting diodes LD1, LD2, LD3, and LD4, respectively. The outputs of the AND gates 89, 91, 93, and 95 drive the PMOS transistors 97, 99, 101, 103 to turn on or off the LD, LD2, LD3, and LD4, respectively. The time (S1, S2, S3, and S4) during which the LD1 to LD4 are turned on varies depending on the pulse width of the head strobe HD-STB-N received from the head controller 55.

Each array 105 includes LD1, LD2, . . . , LD384 aligned in a straight line. Therefore, the LED head 5 includes a total of 384×26=9984 LEDs. Four consecutive LEDs form a corresponding one pixel. The LD1, LD2, LD3, and LD4 are driven by the 4 drive signals DR-D1[0], DR-D1[1], DR-D1[2], and DR-D1[3], respectively, outputted from corresponding PMOS transistors 97, 99, 101, and 103 of the bit driver DR1. The LD1-LD384 are disposed at intervals of about 0.0212 mm (i.e., 1200 LEDs per 1 inch) for implementing a resolution of 1200 dpi.

Figure 13:
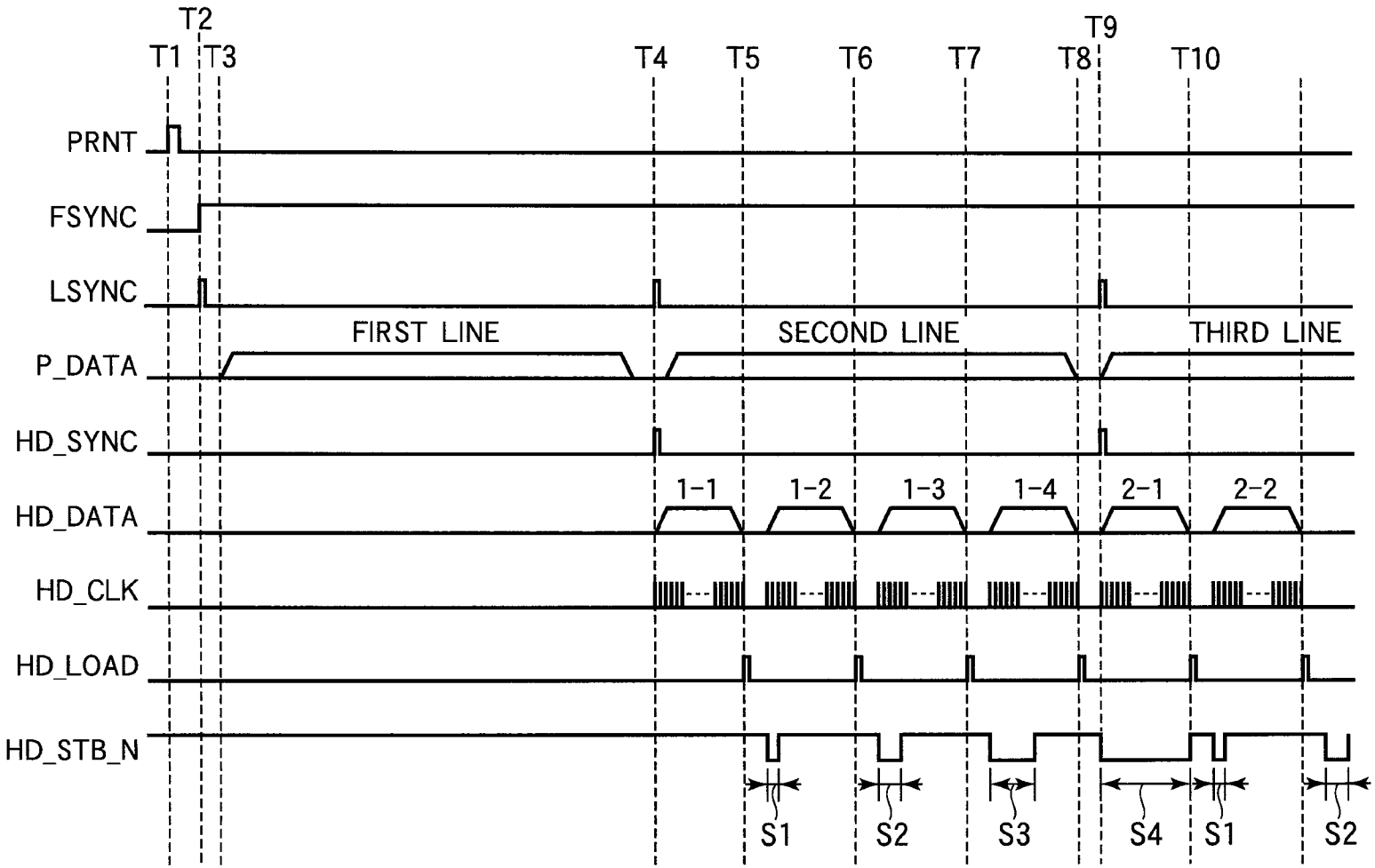
FIG. 13 is a timing chart illustrating the operation of the printer.

FIG. 13 is a timing chart illustrating the operation of the printer. The operation of the printer 1 will be described in detail with reference to FIG. 13.

When the printer receives print data having a resolution of 1200 dpi from a host apparatus, the input section 53 sends the print command PRNT to the head controller 55 at time T1. In response to the print command PRNT, the line sync signal generating section 57 of the head controller 55 outputs the transmission command FSYNC and the line sync signal LSYNC to the input section 53 and the head line sync signal generating section 59 at time T2. In response to the line sync signal LSYNC, the input section 53 initiates transfer of the first line of the print data P-DATA at time T3. The line sync signal generating section 57 again outputs the line sync signal LSYNC at time T4. In response to the line sync signal LSYNC at time T4, the input section 53 initiates transfer of the second line of the print data P-DATA at time T4, and the head line sync signal generating section 59 outputs the head sync signal HD-SYNC. In response to the head sync signal HD-SYNC, the head clock generating section 61 provides the head clock HD-CLK to the LED head 5 and head data transmitting section 63. In response to the line sync signal HD-SYNC, the head data transmitting section 63 sends the head data HD-DATA to the LED head 5.

Figure 14:
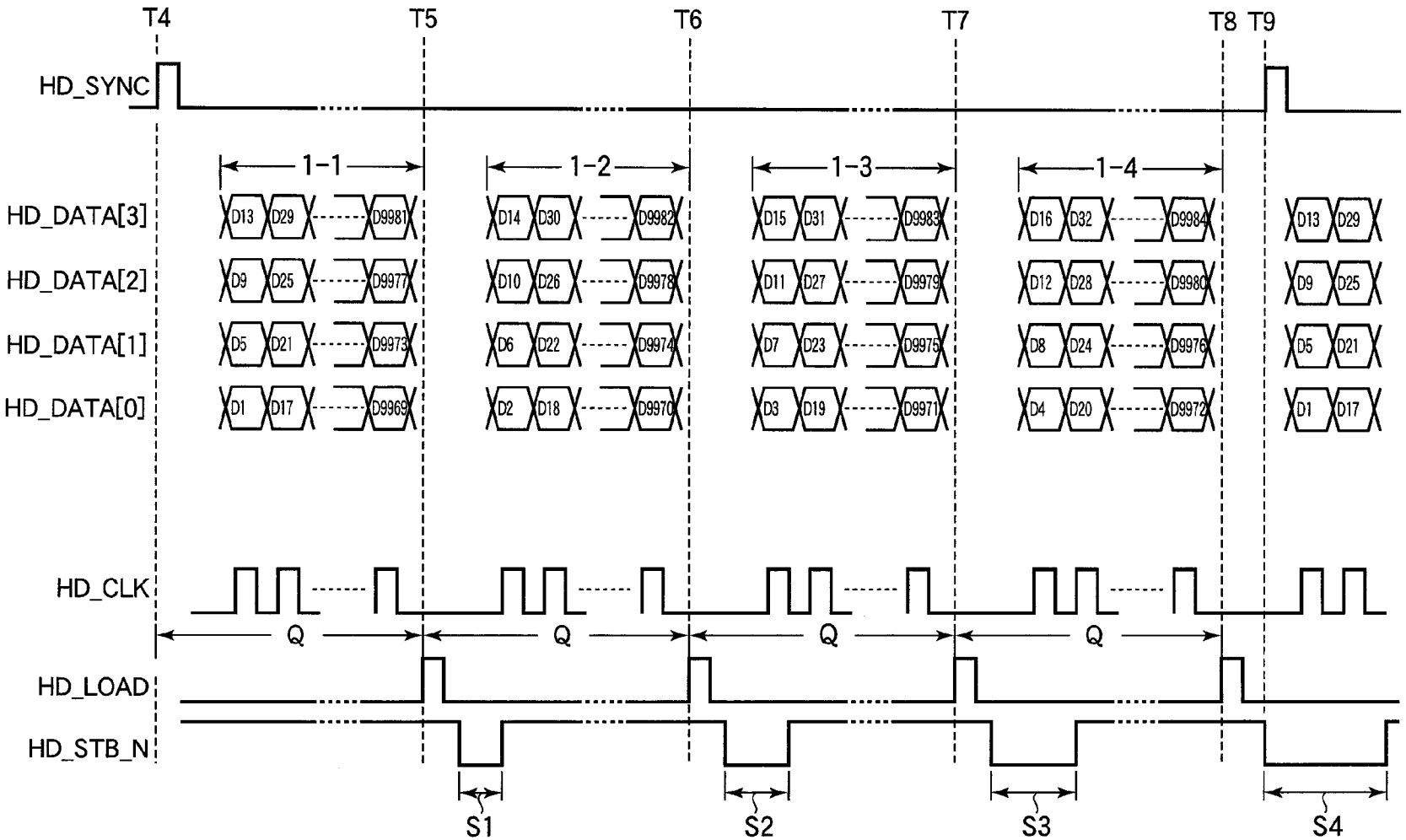
FIG. 14 is a timing chart illustrating the operation of the printer.

FIG. 14 is a timing chart illustrating the operation of the printer.

Figure 15:
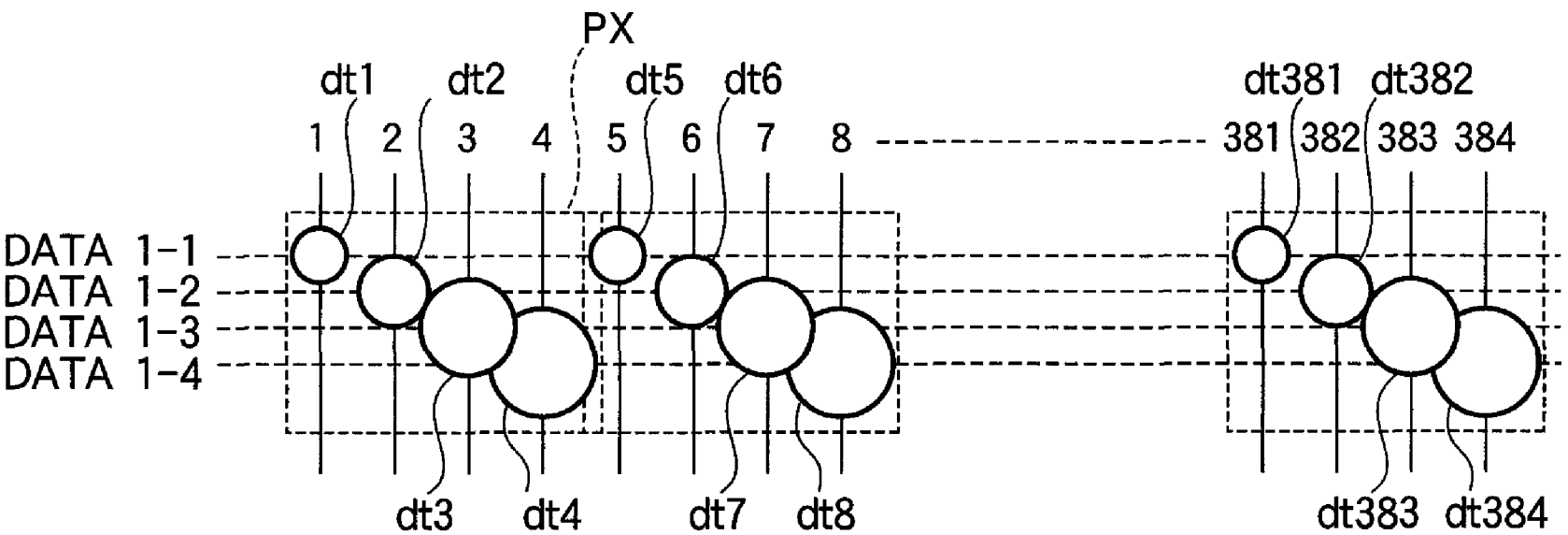
FIG. 15 is another timing chart illustrating the operation of the printer.

FIG. 15 is another timing chart illustrating the operation of the printer.

The HD-DATA fed to the LED head 5 between times T4 and T5 is for driving (n×4+1) th LED in the sub-group where n ranges from 0 to 155. Specifically, as shown in FIG. 14, the head data HD-DATA transferred to the LED head 5 at time T4 is data 1-1 for driving the (n×4+1) th LED of 9984 LEDs where n is an integer greater than 1. More specifically, as shown in FIG. 14, the input section 53 outputs data $\mathbf{1}_{-1}$, i.e., D1, D5, D9 . . . D9977, and D9981 (i.e., 2496 bits in total) which drive $1^{st}$ LED, $5^{th}$ LED, $9^{th}$ LED, . . . $9977^{th}$, and $9981^{st}$ LED, respectively.

Referring to FIG. 14, the data Dz transmitted as the head data HD-DATA[0] is such that z=y×16−15 where Dz is data sent on the y-th head clock HD-CLK. Likewise, the data Dz transmitted as the head data HD-DATA[1] is such that z=y×16−11. The data Dz transmitted as the head data HD-DATA [2] is such that z=y×16−7. The data Dz transmitted as the head data HD-DATA[3] is such that z=y×16−3. The head data HD-DATA[0] to HD-DATA[3] are fed into the shift register 73 in sequence. Upon completion of transfer of data $\mathbf{1}_{-1}$, the 2496 flip flops FF1, FF5, FF9, and FF93 of the line drivers $\mathbf{71}_{-1}$, $\mathbf{71}_{-2}$, $\mathbf{71}_{-3}$, . . . , and $\mathbf{71}_{-26}$.

The following description is another way of describing the operation of the printer.

Referring back to FIGS. 5 and 8, the head controller 55 converts the print data P-DATA into the head data HD-DATA. The head data HD-DATA is divided into 4 groups, HD-DATA [0], HD-DATA[1], HD-DATA[2], and HD-DATA[3]. Each group includes a total of 2496 bits.

Referring to FIG. 14, the head data HD-DATA [0], which is a first quarter (¼) of the print data P-DATA for one line, is sent to the LED head 5 shortly after time T4.

The head data HD-DATA [1], which is a second quarter (¼) of the print data P-DATA for one line, is sent to the LED head 5 shortly after time T5.

The head data HD-DATA [2], which is a third quarter (¼) of the print data P-DATA for one line, is sent to the LED head 5 shortly after time T6.

The head data HD-DATA [3], which is a fourth quarter (¼) of the print data P-DATA for one line, is sent to the LED head 5 shortly after time T7.

More specifically, as shown in FIG. 14, the head controller 55 outputs the head data HD-DATA[0], head data HD-DATA [1], head data HD-DATA[2], and head data HD-DATA[3] to the LED head 5 in sequence. The head data HD-DATA[0], head data HD-DATA[1], head data HD-DATA[2], and head data HD-DATA[3] are all 4-bit data. The head data transmitting section 63 of the head controller 55 outputs the head data HD-DATA [0], HD-DATA [2], and HD-DATA [3] each of which has 2496 bits. The head data HD-DATA[0], head data HD-DATA[1], HD-DATA[2], and HD-DATA[3] are transmitted in sequence to the LED head 5 on a total of 9984 clocks, thereby transmitting a total of 9984 bits for one complete line.

In the present invention, one halftoned dot (i.e., a pixel) of electrostatic latent image is formed by driving 4 consecutive LEDs with corresponding amounts of energy. The items of data $\mathbf{1}_{-1}$, $\mathbf{1}_{-2}$, $\mathbf{1}_{-3}$, and $\mathbf{1}_{-4}$ are used to drive the 4 LEDs, respectively, the data $\mathbf{1}_{-1}$ driving the first one of 4 LEDs, the data $\mathbf{1}_{\times 2}$ driving the second one of 4 LEDs, the data $\mathbf{1}_{-1}$ driving the third one of 4 LEDs.

When the transfer of the data $\mathbf{1}_{-1}$ has completed, the entire data $\mathbf{1}_{-1}$ will have been held in the flip-flops FF1, FF2, FF3, FF4, . . . , FF9971, FF6672, FF9973, FF9984 in each of the line drivers $\mathbf{71}_{-1}$, $\mathbf{71}_{-2}$, . . . $\mathbf{71}_{-26}$.

Likewise, when the transfer of the data $\mathbf{1}_{-2}$ has completed, the entire data $\mathbf{1}_{-2}$ will have been held in the flip-flops FF1, FF2, FF3, FF4, . . . , FF93, FF94, FF95, FF96 in each of the line drivers $\mathbf{71}_{-1}$, $\mathbf{71}_{-2}$, . . . $\mathbf{71}_{-26}$.

When the transfer of the data $\mathbf{1}_{-3}$ has completed, the entire data $\mathbf{1}_{-3}$ will have been held in the flip-flops FF1, FF2, FF3, FF4, . . . , FF93, FF94, FF95, FF96 in each of the line drivers $\mathbf{71}_{-1}$, $\mathbf{71}_{-2}$, . . . $\mathbf{71}_{-26}$.

When the transfer of the data $\mathbf{1}_{-4}$ has completed, the entire data $\mathbf{1}_{-4}$ will have been held in the flip-flops FF1, FF2, FF3, FF4, . . . , FF93, FF94, FF95, FF96 in each of the line drivers $\mathbf{71}_{-1}$, $\mathbf{71}_{-2}$, . . . $\mathbf{71}_{-26}$.

When the line sync signal generating section 57 again generates the line sync signal LSYNC at time T4, the transfer of the print data P-DATA for the second line is initiated.

The head latch generating section 65 outputs the head load signal HD-LOAD at time T5. The time elapsed from time T4 to time T5 is the amount of time required for the surface of the photoconductive drum 7 to rotate through an angle equivalent to a circumferential distance of 0.0053 mm corresponding to 4800 dpi, which is the distance between adjacent lines in an advance direction (i.e., direction of travel of the paper P) if the distance between lines at a resolution of 1200 dpi is divided into four equal parts. Upon receiving the head load signal HD-LOAD, the latches 75 latch the data $\mathbf{1}_{-1}$ held in the shift registers 73. Upon receiving the head load signal HD-LOAD from the head latch generating section 65, the drive pulse generating section 67 reads one of the pulse widths stored from the drive pulse storing area 69, and generates the head strobe HD-STB-N, which in turn is inputted into the LED head 5.

The pulse width of the head strobe HD-STB-N at this moment is S1. Upon receiving the head strobe HD-STB-N, the bit-drivers DR1, DR2, DR3, . . . , DR96 drive the LEDs LD1, LD5, LD9, . . . , LD9981 that correspond to the data $\mathbf{1}_{-1}$. Specifically, when the selector signal SEL1 is inputted from the selector circuit 79 to the AND gate 81, if the head strobe HD-STB-N is fed to the bit-drivers DR1, DR2, DR3, . . . , DR96, only the AND gate 89 opens to output a signal, which turns on the PMOS transistor 97. As a result, the LD1 connected to the PMOS transistor 97 is driven.

When the head clock generating section 61 receives the head load signal HD-LOAD at time T5, data $\mathbf{1}_{-2}$ for driving the (n×4+2)th LED of 9984 LEDs is fed to the shift register 73. Likewise, data $\mathbf{1}_{-3}$ for driving the (n×4+3)th LED of 9984 LEDs is fed to the shift register 73 at time T6. Data $\mathbf{1}_{-4}$ for driving the (n×4+4)th LED of 9984 LEDs is fed to the shift register 73 at time T7. In other words, for the items of data $\mathbf{1}_{-1}$, $\mathbf{1}_{-2}$, $\mathbf{1}_{-3}$, and $\mathbf{1}_{-4}$, a following one of two items of data is inputted into the LED head 5 an amount of time after a preceding one of the two items of data, the amount of time being a quarter of the time required for sending head data HD-DATA for one line.

The following description is another way of describing the operation of the printer.

When the head clock generating section 61 receives the head load signal HD-LOAD at time T5, data $\mathbf{1}_{-2}$ for driving the LEDs LD2, LD6, LD10, . . . , LD9982 is fed to the shift register 73 of the line driver 71. Likewise, the data $\mathbf{1}_{-3}$ for driving the LEDs LD3, LD7, LD11, . . . , LD9983 is fed to the shift registers 73 of the line driver $\mathbf{71}_{-1}$ to $\mathbf{71}_{-26}$ at time T6. The data $\mathbf{1}_{-3}$ for driving the LEDs LD4, LD8, LD12, . . . , LD9984 is fed to the shift register 73 of the line driver $\mathbf{71}_{-1}$ to $\mathbf{71}_{-26}$ at time T7.

In other words, for the items of data $\mathbf{1}_{-1}$, $\mathbf{1}_{-2}$, $\mathbf{1}_{-3}$, and $\mathbf{1}_{-4}$, a following one of two items of data is inputted into the LED head 5 an amount of time after inputting a preceding one of the two items of data, the amount of time being a quarter of the time required for sending head data HD-DATA for one line.

The pulse widths of the head strobe HD-STB-N for the data $\mathbf{1}_{-1}$, $\mathbf{1}_{-2}$, $\mathbf{1}_{-3}$, and $\mathbf{1}_{-4}$ are S1, S2, S3, and S4, respectively. The pulse widths S1, S2, S3, and S4 are related such that S2=2×S1, S3=2×S2, and S4=2×S3. In this manner, the energy for driving an LED is such that a following one of adjacent data has twice as large an amount of energy as a preceding one of the adjacent data. Thus, dots of electrostatic latent image are formed on the photoconductive drum 7, being staggered in the advance direction (direction of travel of the paper P) with adjacent dots having sizes different by a factor of 2. For example, a dot formed by the light emitting diode LD2 has a size dt2, which is twice as large as a dot having a size dt1. This energy allocation provides 16 different halftone levels for a single pixel.

As described above, the LD1, LD2, . . . , LD9984 are divided into a plurality of groups each of which includes 4 LEDs. Each of the plurality of groups forms a single pixel. For example, four LEDs are driven with four different amounts of energy, each LED being driven with an amount of energy different from the remainders. This provides 16 halftone levels for a single pixel.

Second Embodiment

A printer of a second embodiment has a similar configuration to that of the first embodiment. Elements similar to those of the first embodiment have been given the same reference numerals and their description is omitted.

Figure 16A:
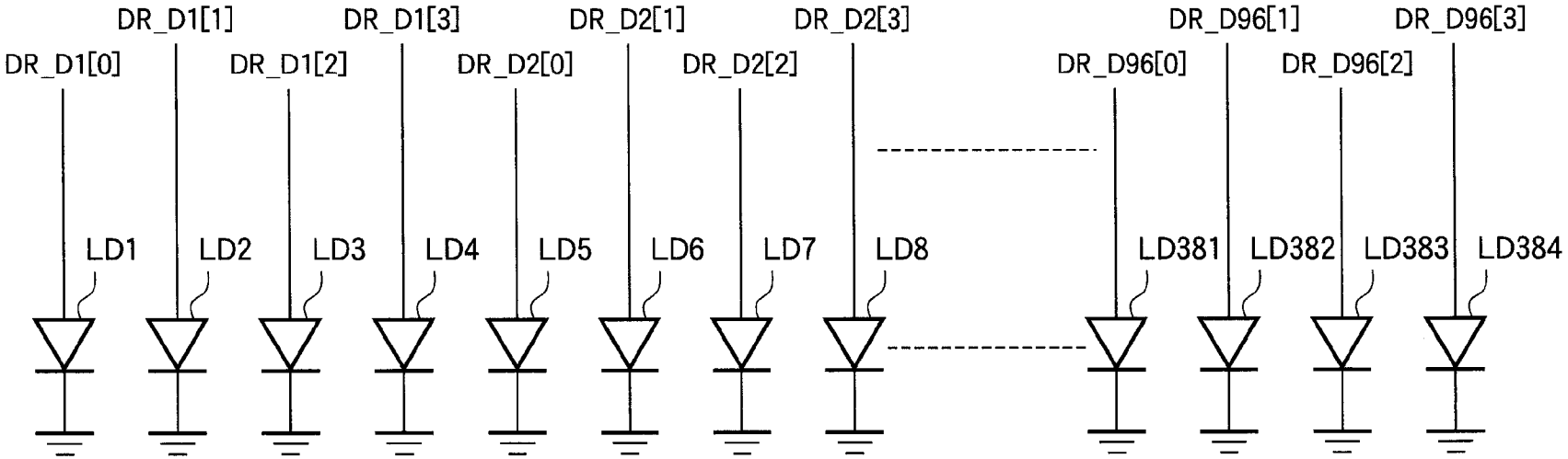
FIG. 16A illustrates LEDs of a second embodiment.

FIG. 16A illustrates LEDs of a second embodiment.

Figure 16B:
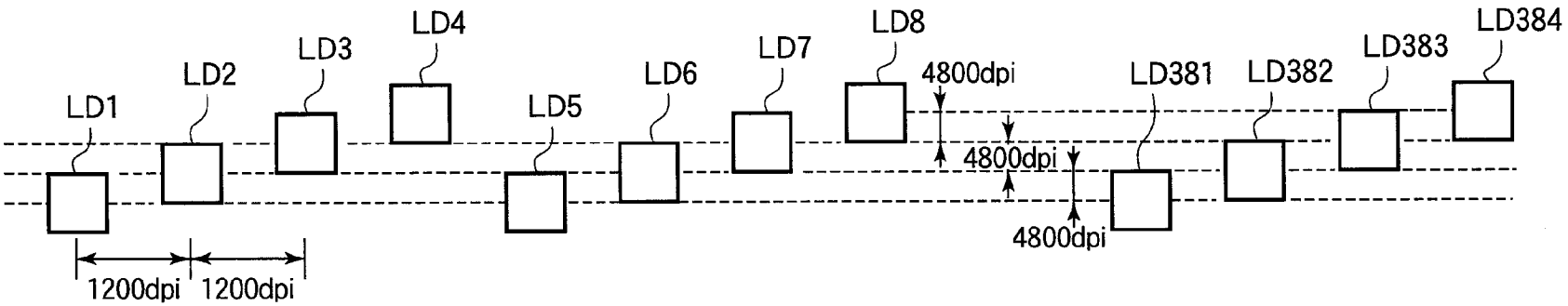
FIG. 16B illustrates the arrangement of the LEDs of FIG. 16A.

FIG. 16B illustrates the arrangement of the LEDs.

Referring to FIG. 16A, the four LEDs for forming a single pixel staggered such that each of the four LEDs is displaced ahead of the preceding one in the advance direction (direction of travel of paper P).

The distance between adjacent LEDs in the advance direction is calculated using a resolution Xn. Assume that a printer 1 is capable of printing at a resolution of 1200 dpi and that four LEDs are used to form an electrostatic latent image of a single pixel. The distance between the adjacent LEDs aligned in the advance direction is a distance equivalent to a resolution of 4800 (=4×1200) dpi. Specifically, the distance between the adjacent LEDs in the advance direction is approximately 0.0053 mm. A most upstream one of the four LEDs with respect to the direction of shifting in the shift register is positioned most downstream of the others in the advance direction.

The operation of the printer 1 incorporating the LED arrays arranged in the aforementioned manner will be described in detail by way of example of LD1, LD2, LD3, and LD4.

FIG. 17 illustrates the dots formed on the photoconductive drum.

The data $\mathbf{1}_{-2}$ for driving the LD2 is inputted into the LED head 5 an amount of time after the data $\mathbf{1}_{-1}$ for driving the LD1 has been inputted into the LED head 5, the amount of time being equivalent to a quarter of a line. The surface of the photoconductive drum 7 rotates through an angle equivalent to a distance equivalent to 4800 dpi, which is a resolution of a quarter of the resolution in the advance direction. Thus, the LEDs are staggered taking into account the timing at which the data is inputted. Thus, as shown in FIG. 17, the dot formed on the photoconductive drum may be aligned in a straight line without distortion.

The present invention is not limited to the aforementioned embodiments but may be modified within the scope of the invention.

FIG. 18A illustrates the arrangement of the LEDs of the second embodiment.

FIG. 18B illustrates the dots formed on the photoconductive drum using the arrangement of the LEDs shown in FIG. 18A. The drive energy is larger for upstream LEDs with respect to the shifting direction of data through the shift register in the traverse direction than for downstream LEDs. Conversely, the drive energy may be selected to be larger for LEDs downstream with respect to the direction of shifting than for upstream LEDs. In this manner, the adjacent dots of electrostatic latent image formed may be made on the photoconductive drum smaller stepwise as shown in FIG. 18A. Thus, the adjacent dots formed on the surface of the photoconductive drum 7 may be made smaller stepwise along a straight line on the surface of the photoconductive drum 7 as shown in FIG. 18B.

In the aforementioned embodiments, the amount of energy required for driving the LEDs is varied in terms of the pulse width of the head strobe HD-STB-N. Alternatively, the amount of energy for driving the LEDs may be controlled by changing the current flowing through the LEDs, thereby controlling the size of dots.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a photoconductive body;

a light emitting element array in which a plurality of light emitting elements are aligned, the light emitting element array emitting light to form an electrostatic latent image of a pixel on the photoconductive drum; and a controller that controllably drives the plurality of light emitting elements to form the electrostatic latent image, each pixel being formed by a combination of a total of N (N>1) light emitting elements, wherein each element of the N light emitting elements is driven with a different amount of energy from remainders of the N light emitting elements.

2. The image forming apparatus according to claim 1, wherein the N light emitting elements are arranged so that they are staggered, each of four light emitting elements being displaced ahead of a preceding one in the advance direction by a distance equivalent to a first resolution provided that the electrostatic latent image is formed on the photoconductive drum at a second resolution in a direction perpendicular to the advance direction.

3. The image forming apparatus according to claim 2, wherein each of the N light emitting elements is driven with a different amount of time from remainders of the N light emitting elements.

4. The image forming apparatus according to claim 3, further comprising a strobe signal generating section that generates a plurality of strobe signals each of which has a different duration from remainders of the plurality of strobe signals;

wherein each of the N light emitting elements is driven by a corresponding one of the plurality of strobe signals.

5. The image forming apparatus according to claim 2, wherein the plurality of light emitting elements are light emitting diodes.

6. The image forming apparatus according to claim 1, wherein each of the N light emitting elements is driven with a different amount of time from remainders of the N light emitting elements.

7. The image forming apparatus according to claim 6, further comprising a strobe signal generating section that generates a plurality of strobe signals each of which has a different duration from remainders of the plurality of strobe signals;

wherein each of the N light emitting elements is driven by a corresponding one of the plurality of strobe signals.

8. The image forming apparatus according to claim 7, wherein the plurality of light emitting elements are light emitting diodes.

9. The image forming apparatus according to claim 6, wherein the plurality of light emitting elements are light emitting diodes.

10. The image forming apparatus according to claim 1, wherein the plurality of light emitting elements are light emitting diodes.

* * * * *